US008480434B2

(12) United States Patent
Funayama et al.

(10) Patent No.: US 8,480,434 B2
(45) Date of Patent: Jul. 9, 2013

(54) TERMINAL FOR ELECTRICAL CONNECTION AND CONNECTOR USING SAME

(75) Inventors: Daisuke Funayama, Kanagawa (JP); Tomisaburo Yamaguchi, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 13/377,460

(22) PCT Filed: May 24, 2010

(86) PCT No.: PCT/JP2010/058718

§ 371 (c)(1),
(2), (4) Date: Feb. 17, 2012

(87) PCT Pub. No.: WO2010/143520

PCT Pub. Date: Dec. 16, 2010

(65) Prior Publication Data

US 2012/0142226 A1 Jun. 7, 2012

(30) Foreign Application Priority Data

Jun. 10, 2009 (JP) ..... 2009-139399

(51) Int. Cl.
*H01R 24/00* (2011.01)

(52) U.S. Cl.
USPC ..... 439/637

(58) Field of Classification Search
USPC ..... 439/637, 638, 74, 515
See application file for complete search history.

(56) References Cited

U.S. PATENT DOCUMENTS

| | | | | |
|---|---|---|---|---|
| 5,749,750 | A * | 5/1998 | Yu et al. | 439/637 |
| 7,637,783 | B2 * | 12/2009 | Sasaoka et al. | 439/637 |
| 2002/0022381 | A1 | 2/2002 | Ito et al. | |

FOREIGN PATENT DOCUMENTS

| | | | |
|---|---|---|---|
| JP | 40-036036 | Y1 | 12/1965 |
| JP | 2002-056910 | A | 2/2002 |
| JP | 2002-175847 | A | 6/2002 |

OTHER PUBLICATIONS

International Search Report for PCT/JP2010/058718 mailed Jun. 15, 2010.

* cited by examiner

*Primary Examiner* — Phuong Dinh
(74) *Attorney, Agent, or Firm* — Lowe Hauptman Ham & Berner, LLP

(57) ABSTRACT

An electrical connection terminal arranged such that when the amount of displacement of one of a first contact portion and a second contact portion increases, a decrease in the contact pressure of the other contact portion is effectively suppressed, and a connector in which the electrical connection terminal is used. Between first and second elastic pieces and a fixed piece, a third elastic piece is provided such that when one of a first contact portion and a second contact portion is displaced in the direction of contact with a mating terminal, the amount of displacement of the other contact portion in the direction of contact with the mating terminal becomes smaller than the amount of displacement of the other contact portion in the insertion and removal direction of the mating terminal. Connection reliability by two-point contact may be improved.

6 Claims, 6 Drawing Sheets

TERMINAL FOR ELECTRICAL CONNECTION AND CONNECTOR USING SAME

RELATED APPLICATIONS

The present application is a National Phase of International Application Number PCT/JP2010/058718, filed May 24, 2010 and claims priority from, Japanese Application Number 2009-139399, filed Jun. 10, 2009.

TECHNICAL FIELD

The present invention relates to an electrical connection terminal used for establishing an electrical connection to a mating terminal, which is used, for example, in a connector to connect substrates together, and a connector in which this electrical connection terminal is used.

BACKGROUND ART

As a connector of this kind, there has hitherto been known a connector which is provided with a connector body into which the connecting part of a mating connector is inserted and a plurality of terminals spaced from each other widthwise in the connector body, and which is such that when the connecting part of the mating connector is inserted into the connector body, each of the terminals comes into contact with the mating terminal while the terminal is being elastically deformed (refer to Patent Literature 1, for example).

A terminal used in this connector is provided with a first contact portion and a second contact portion which are spaced from each other in the insertion and removal direction of a mating terminal, a first elastic piece which is provided with the first contact portion and is capable of elastic deformation in the direction of contact with a mating terminal, and a second elastic piece which is provided with a second contact portion and is capable of elastic deformation in the direction of contact with a mating terminal, and the first and second contact portions are adapted to come into contact with the same widthwise position of the mating terminal.

That is, in the above-described terminal, because the two contact portions come into contact with the same mating terminal, for example, even when a foreign substance gets between one contact portion and the mating terminal, the condition of conduction to the mating terminal is ensured by the other contact portion, making it possible to prevent poor connection.

CITATION LIST

Patent Literature

[Patent Literature 1] Japanese Patent Publication No. 2002-175847

SUMMARY OF INVENTION

Technical Problem

In the above-described terminal, the first and second elastic pieces are formed so as to extend each obliquely from the terminal body toward the mating terminals and, therefore, if one of the first and second elastic pieces is elastically deformed, also the other elastic piece is displaced in the same direction. For this reason, for example, in a case where a foreign substance gets between one of the first and second contact portions and a mating terminal, if the amount of displacement of one contact portion increases due to the presence of the foreign substance, in association with this, also the other contact portion is displaced in the direction in which the other contact portion departs from the mating terminal, posing the problem that the contact pressure of the other contact portion is reduced thereby. Also, in a case where the first and second contact portions in a noncontact condition produce a relative displacement in the direction of contact with the mating terminal due to manufacturing errors, deformation occurring during use and the like, upon contact with the mating terminal, and in association with this, the amount of displacement of the contact portion having a larger amount of projection to the mating terminal becomes larger than that of the other contact portion, the amount of the other contact portion becomes larger, similarly posing the problem that the contact pressure of the other contact portion is reduced thereby.

The present invention was made in view of the above-described problems, and the object of the present invention is to provide an electrical connection terminal which is such that even when the amount of displacement of one of a first contact portion and a second contact portion becomes larger than that of the other contact portion, it is possible to effectively suppress a decrease in the contact pressure of the other contact portion which is caused by this increase, and a connector in which this electrical connection terminal is used.

Solution to Problem

To achieve the above-described object, an electrical connection terminal of the present invention is provided with a first contact portion and a second contact portion which are arranged in such a manner that positions of contact with a mating terminal are different from each other and which come into contact with the mating terminal in the direction orthogonal to the insertion and removal direction of the mating terminal; a first elastic piece which is provided with a first contact portion and is capable of elastic deformation in the direction of contact with the mating terminal; a second elastic piece which is provided with a second contact portion and is capable of elastic deformation in the direction of contact with the mating terminal, and a fixed piece which is fixed outside; and a third elastic piece which is provided between the first and second elastic pieces and the fixed piece, is elastically deformed in such a manner that the amount of displacement of the second contact portion in the direction of contact with the mating terminal becomes smaller than the amount of displacement of the second contact portion in the insertion and removal direction of the mating terminal when the first contact portion is displaced in the direction of contact with the mating terminal, and is elastically deformed in such a manner that the amount of displacement of the first contact portion in the direction of contact with the mating terminal becomes smaller than the amount of displacement of the first contact portion in the insertion and removal direction of the mating terminal when the second contact portion is displaced in the direction of contact with the mating terminal.

As a result of this, when one of the first and second contact portions is displaced in the direction of contact with the mating terminal, the third elastic piece is elastically deformed in such a manner that the amount of displacement of the other contact portion in the direction of contact with the mating terminal becomes smaller than the amount of displacement of the mating terminal in the insertion and removal direction. Therefore, the amount of displacement of the other contact portion in the direction of contact with the mating terminal associated with the displacement of the one contact point becomes exceedingly small compared to the amount of displacement of one contact portion, with the result that a decrease in the contact pressure of the other contact portion is suppressed.

Advantageous Effects of Invention

According to the present invention, even when the amount of displacement of one of the first and second contact portions increases, it is possible to suppress a decrease in the contact pressure of the other contact portion which is caused by this increase and, therefore, this is very advantageous in improving the connection reliability by two-point contact.

DESCRIPTION OF EMBODIMENTS

Figure 1:
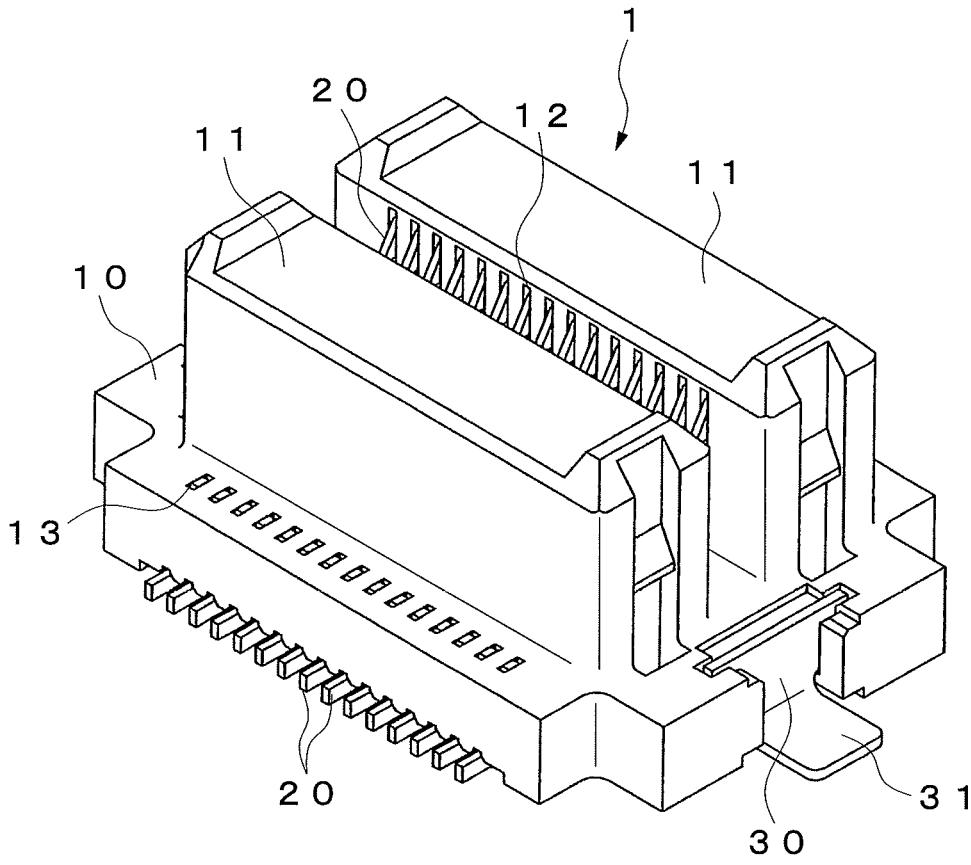
FIG. 1 is a perspective view showing an embodiment of a connector provided with an electrical connection terminal of the present invention.
Figure 2:
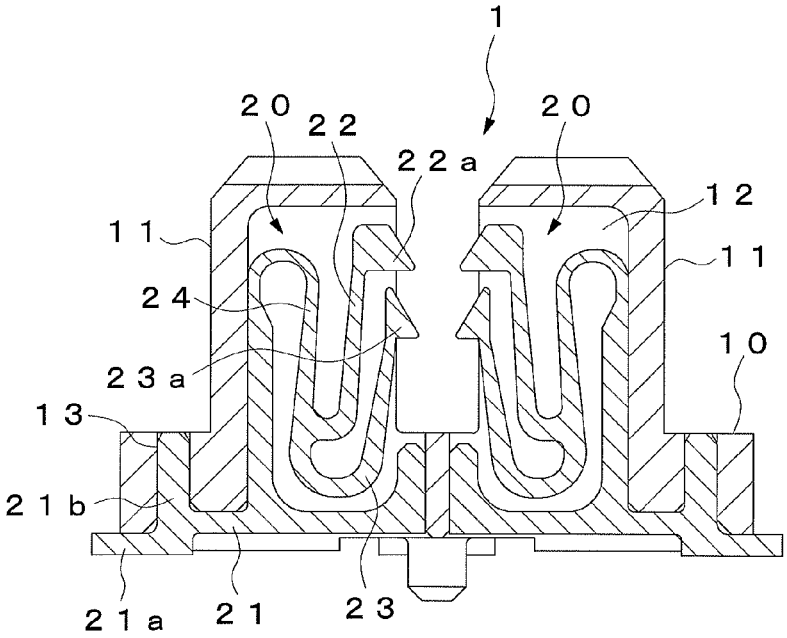
FIG. 2 is a side sectional view of a connector.
Figure 3:
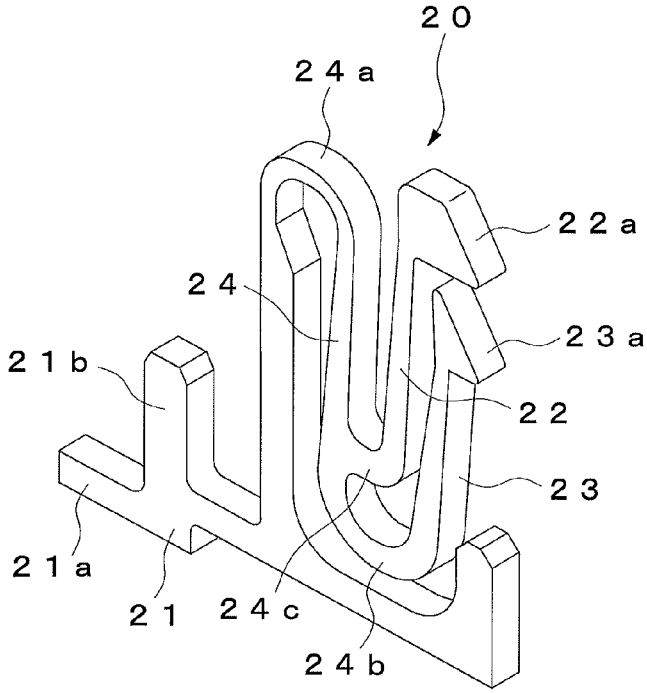
FIG. 3 is a perspective view of a terminal.

FIGS. 1 to 7 show an embodiment of the present invention. A connector 1 shown in the figures is fixed to a substrate which is not shown and is used by being connected to a mating connector 2 fixed to another substrate.

This connector 1 is composed of a housing 10 which fits to a mating connector 2, a plurality of terminals 20 spaced in the housing 10 from each other widthwise, and a pair of fixing members 30 which fixes the housing 10 to the substrate.

The housing 10 is formed from a molded article of synthetic resin, and on the top surface side thereof there is provided a pair of projections 11 which fits to the mating connector 2. The projections 11 are spaced from each other in the front-back direction of the housing 10 and it is ensured that part of the mating connector 2 is inserted between the projections 11. In each of the projections 11, a plurality of terminal holes 12 accommodating each of the terminals 20 are spaced from each other widthwise and each of the terminal holes 12 is open on a surface opposed to each of the projections 11. On the front end side and rear end side of the housing 10, fixing holes 13 for fixing each of the terminals 20 are spaced from each other widthwise.

Each of the terminals 20 is formed from an electrically conductive metal plate, and the terminals 20 are arranged in one row widthwise within each of the projections 11 of the housing 10. In this case, the terminals 20 in one row and the terminals 20 in the other row are arranged in such a manner that the contact portions in contact with the mating terminals face each other. Each of the terminals 20 is composed of a fixed piece 21 fixed to the housing 10, a first elastic piece 22 and a second elastic piece 23 which are capable of elastic deformation in the front-back direction of the housing 10, and a third elastic piece 24 formed between the first and second elastic pieces 22, 23 and the fixed piece 21, and it is ensured that each of the first and second elastic pieces 22, 23 comes into contact with the mating terminal. In this case, the terminal 20 is formed by blanking an electrically conductive metal plate in a thickness direction and it is ensured that the width direction of the fixed piece 21 and each of the elastic pieces 22, 23, 24 becomes the thickness direction of the metal plate.

The fixed piece 21 is formed so as to extend in a front-back direction along the bottom surface of the housing 10, and a connecting part 21*a* which is connected to a substrate is provided on the side of one end of the fixed piece 21. The fixed piece 21 has an extending portion 21*b* which extends upward and it is ensured that the fixed piece 21 is fixed to the housing 10 by press-fitting the extending portion 21*b* into the fixing hole 13 of the housing 10.

The first and second elastic pieces 22, 23 are each formed so as to extend in an up-and-down direction, a first contact portion 22*a* which comes into contact with the mating terminal is provided at the upper end of the first elastic piece 22 and a second contact portion 23*a* which comes into contact with the mating terminal is provided at the upper end of the second elastic piece 23. The first and second contact portions 22*a*, 23*b* are formed so as to project in angular form, and it is ensured that the extremities thereof come into contact with the mating terminal. In this case, the first contact portion 22*a* is arranged above the second contact portion 23*a*, and it is ensured that the first and second contact portions 22*a*, 23*b* come into contact with the same widthwise position of the mating terminal.

The third elastic piece 24 is formed in such a manner that the side of one end thereof extends upward from the fixed piece 21 and is bent in a U-shape while the side of the other end extends downward, whereby it is ensured that elastic deformation occurs in the front-back direction of the housing 10, with this U-shaped bent portion 24*a* serving as a base point. At the lower end on the side of the other end of the third elastic piece 24, the bottom-end side of the second elastic piece 23 is integrally formed so as to be bent in a U-shape, whereby it is ensured that the second elastic piece 23 is elastically deformed in the front-back direction of the housing 10, with this U-shaped bent portion 24*b* serving as a base point. On the lower-end side on the side of the other end of the third elastic piece 24, the lower-end side of the first elastic piece 22 is integrally formed so as to be bent in a U-shape, whereby it is ensured that the first elastic piece 22 is elastically deformed in the front-back direction of the housing 10, with this U-shaped bent portion 24*c* serving as a base point. In this case, it is ensured that the first elastic piece 22 is arranged between the second elastic piece 23 and the third elastic piece 24, and that the second contact portion 23*a* is positioned between the first elastic piece 22 and the mating terminal.

Figure 4A:
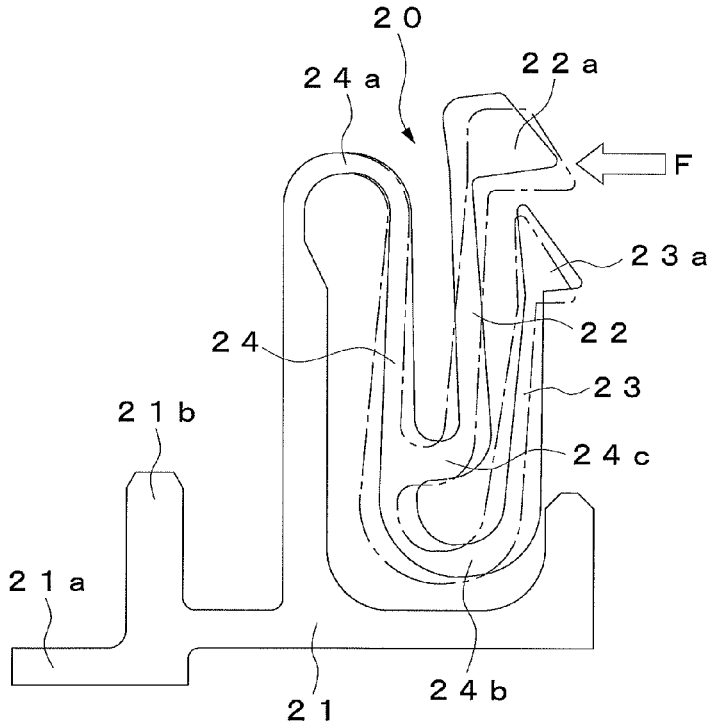
FIG. 4A is a side view showing an action of a terminal.
Figure 5A:
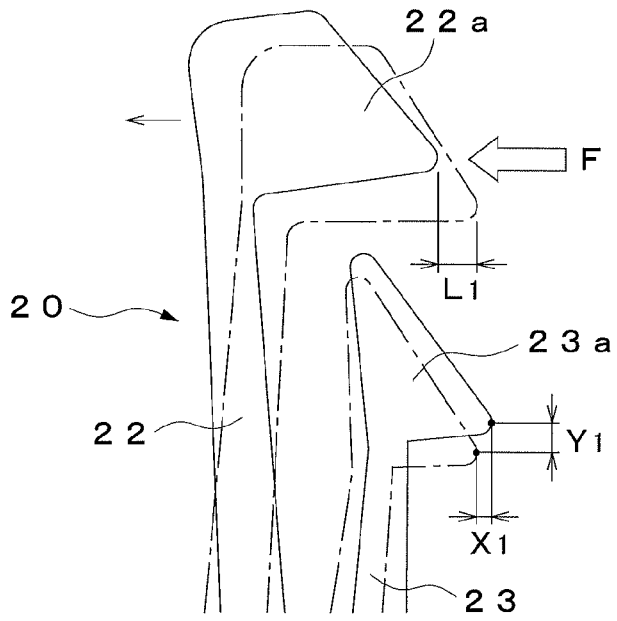
FIG. 5A is an enlarged side view showing an action of a terminal.

That is, the terminal 20 is such that as shown in FIG. 4A, when a pressing force F in a front-back direction is applied to the first contact portion 22*a*, the first elastic piece 22 and the third elastic piece 24 are elastically deformed, with the bent portion 24*c* and the bent portion 24*a*, respectively, serving as a base point and, as shown in FIG. 5A, the first contact portion 22*a* is displaced by L1 in a front-back direction (the direction of contact with the mating terminal). On that occasion, the third elastic piece 24 is elastically deformed so that the amount of displacement X1 of the second contact portion 23*a* in a front-back direction becomes smaller than the amount of displacement Y1 in an up-and-down direction (the insertion and removal direction of the mating terminal). As a result of this, the amount of displacement X1 of the second contact portion 23*a* in a front-back direction caused by the displacement of the first contact portion 22*a* becomes exceedingly small compared to the amount of displacement L1 of the first contact portion 22*a*.

Figure 4B:
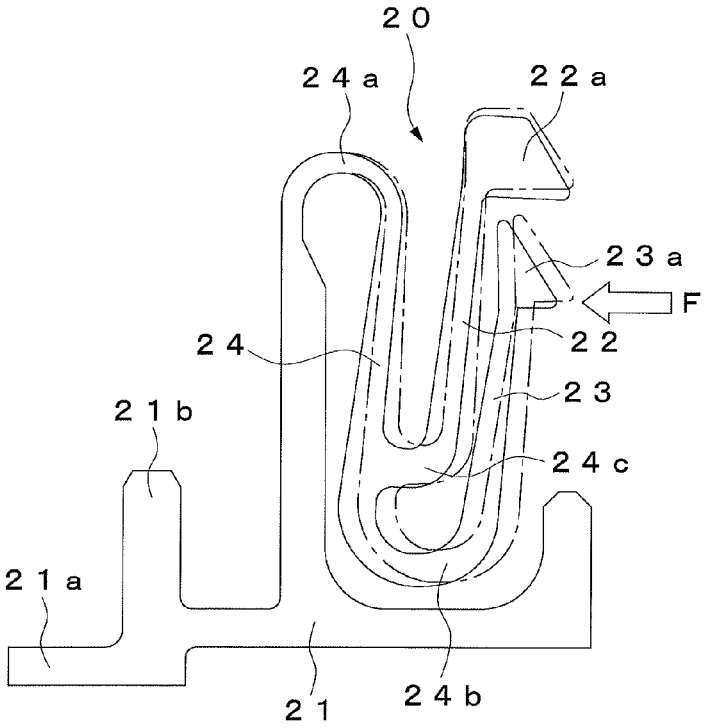
FIG. 4B is a side view showing an action of a terminal.
Figure 5B:
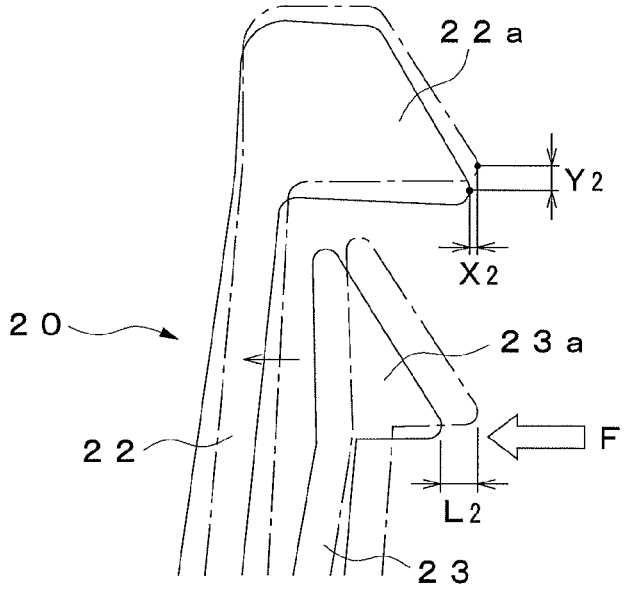
FIG. 5B is an enlarged side view showing an action of a terminal.
Figure 6:
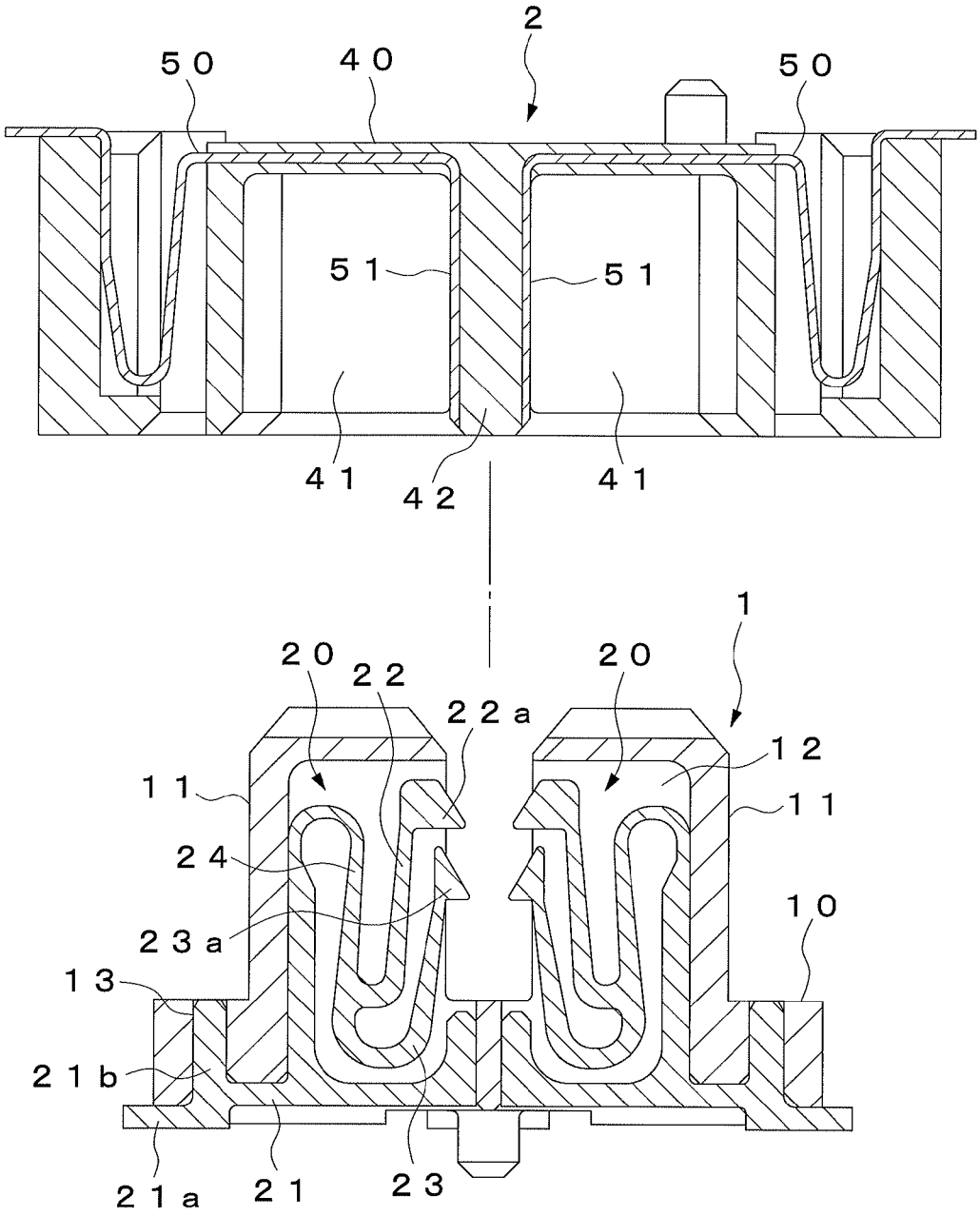
FIG. 6 is a side sectional view showing the process of connection to a mating connector.

Also, the terminal 20 is such that as shown in FIG. 4B, when a pressing force F in a front-back direction is applied to the second contact portion 23*a*, the second elastic piece 23 and the third elastic piece 24 are elastically deformed, with the bent portion 24*b* and the bent portion 24*a*, respectively, serving as a base point and, as shown in FIG. 5B, the second contact portion 23*a* is displaced by L2 in a front-back direction (the direction of contact with the mating terminal). On that occasion, the third elastic piece 24 is elastically deformed so that the amount of displacement X2 of the first contact portion 22*a* in a front-back direction becomes smaller than the amount of displacement Y2 in an up-and-down direction (the insertion and removal direction of the mating terminal). As a result of this, the amount of displacement X2 of the first contact portion 22*a* in a front-back direction caused by the displacement of the second contact portion 23*a* becomes exceedingly small compared to the amount of displacement L2 of the second contact portion 23*a*.

Each of the fixing members 30 is formed from a metal plate which is bent in an L-shape and is fixed to both sides of widthwise ends of the housing 10. On the lower-end side of each of the fixing members 30, there is provided a connecting part 31 which extends to the widthwise outer side of the housing 10 and it is ensured that the connecting part 31 is connected by soldering to a substrate, which is not shown.

The mating connector 2 is provided with a housing 40 which fits to the connector 1, and a plurality of mating terminals 50 which are spaced in the housing 40 from each other widthwise. On the lower surface of the housing 40, there is provided a pair of concave portions 41 which receive each of the projections 11 of the connector 1. A connecting part 42 to the connector 1 is provided between the concave portions 41, and on each of both surfaces of the connecting part 42, there is arranged a contact portion 51 of the mating terminal 50.

Figure 7:
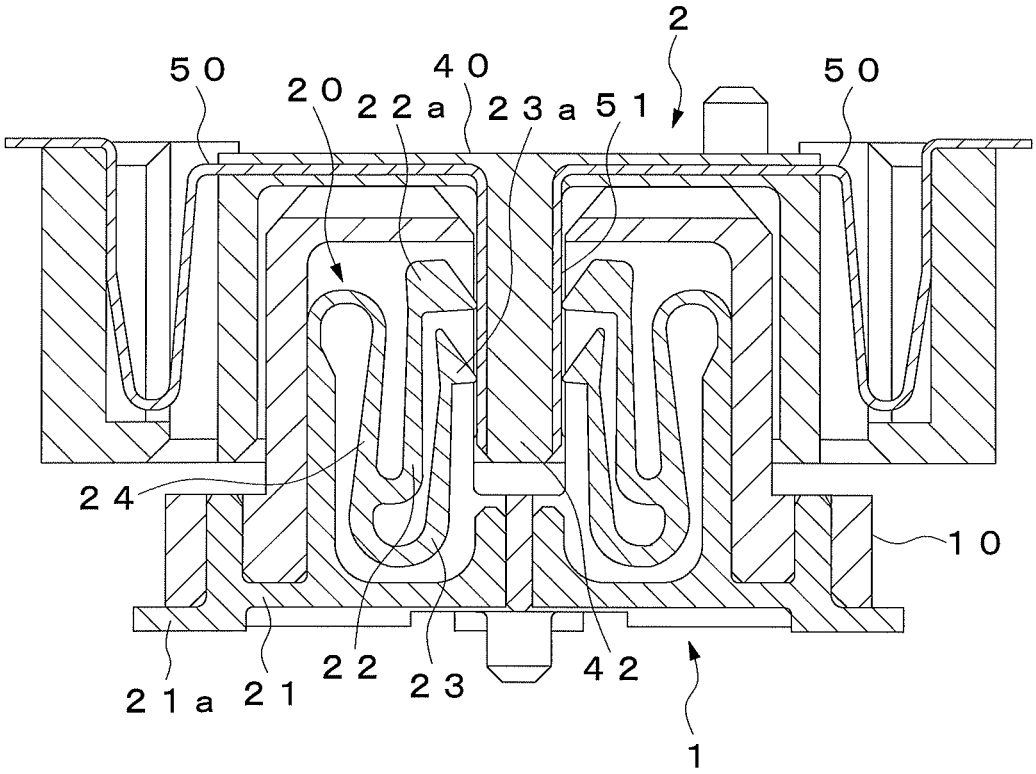
FIG. 7 is a side sectional view showing the condition of connection to a mating connector.

Each of the connectors 1, 2 configured as described above is such that as shown in FIG. 6, each of the projections 11 and each of the concave portions 41 are fitted to each other, whereby as shown in FIG. 7, the connecting part 42 of the mating connector 2 is inserted between the projections 11, and each of the terminals 20 of the connector 1 comes into contact with each of the mating terminals 50. On that occasion, the first and second contact portions 22*a*, 23*a* of the terminal 20 come into contact with the same widthwise position of the mating terminal 50, with a space provided in the insertion direction of the mating terminal 50 and, therefore, the terminal 20 comes into contact with the same mating terminal 50 at two points.

In a case where a foreign substance gets between one of the first and second contact portions 22*a*, 23*a* and the mating terminal 50 and in a case where the first and second contact portions 22*a*, 23*a* in a noncontact condition produce a relative displacement in the direction of contact with the mating terminal 50 due to manufacturing errors, deformation occurring during use and the like, upon contact with the mating terminal 50, the amount of displacement of one contact portion becomes larger than the amount of displacement of the other contact portion, but as described above, due to the presence of the third elastic piece 24 the amount of displacement of the other contact portion becomes exceedingly small compared to the amount of displacement of one contact portion. Therefore, the contact pressure of the other contact portion to the mating terminal 50 does not decrease.

As described above, according to the electrical connection terminal of this embodiment, the third elastic piece 24 is provided between the first and second elastic pieces 22, 23 and the fixed piece 21. This third elastic piece 24 is elastically deformed in such a manner that the amount of displacement of the second contact portion 23*a* in the direction of contact with the mating terminal 50 becomes smaller than the amount of displacement of the second contact portion 23*a* in the insertion and removal direction of the mating terminal 50 when the first contact portion 22*a* is displaced in the direction of contact with the mating terminal 50, and is elastically deformed in such a manner that the amount of displacement of the first contact portion 22*a* in the direction of contact with the mating terminal 50 becomes smaller than the amount of displacement of the first contact portion 22*a* in the insertion and removal direction of the mating terminal 50 when the second contact portion 23*a* is displaced in the direction of contact with the mating terminal 50. Therefore, even when the amount of displacement of one of the first and second contact portions 22*a*, 23*a* increases, it is possible to suppress a decrease in the contact pressure of the other contact portion which is caused by this decrease, and this is very advantageous in improving the connection reliability by two-point contact.

In this case, the first and second contact portions 22*a*, 23*a* are provided in such a manner that the first and second contact portions 22*a*, 23*a* come into contact with the same widthwise position of the mating terminal 50, with a space provided in the insertion and removal direction of the mating terminal 50. Therefore, even when a foreign substance adheres to the contact portion 51 of the mating terminal 50, it is possible to bring the second contact portion 23*a* into contact with the area from which the foreign substance has been removed by the first contact portion 22*a*, which comes into contact first, and even when poor conduction of the first contact portion 22*a* with the mating terminal 50 occurs due to a foreign substance, conduction with the mating terminal 50 can be positively provided by the second contact portion 23*a*.

The first and second elastic pieces 22, 23 are provided so as to be positioned in front-and-back relation with respect to the direction of contact with the mating terminal 50. Therefore, it is possible to reduce the space between the first contact portion 22*a* and the second contact portion 23*a*, and this is very advantageous in miniaturizing the housing 10 in the height direction.

Furthermore, because the electrical connection terminal is formed by blanking an electrically conductive metal plate in a thickness direction in such a manner that the width direction of the fixed piece 21 and each of the elastic pieces 22, 23, 24 becomes the thickness direction of the metal plate, it is possible to form the terminal 20 to the thickness of the metal plate, and this is very advantageous in arranging the terminals 20 widthwise at high density.

REFERENCE SIGNS LIST

1 . . . Connector, 2 . . . Mating connector, 20 . . . Terminal, 21 . . . Fixed piece, 22 . . . First elastic piece, 22*a* . . . First contact portion, 23 . . . Second elastic piece, 23*a* . . . Second contact portion, 24 . . . Third elastic piece, 50 . . . Mating terminal

The invention claimed is:

1. An electrical connection terminal comprising:

a first contact portion and a second contact portion which are arranged in such a manner that positions of contact with a mating terminal are different from each other and which come into contact with the mating terminal in the direction orthogonal to an insertion and removal direction of the mating terminal;

a first elastic piece which is provided with the first contact portion and is capable of elastic deformation in the direction of contact with the mating terminal;

a second elastic piece which is provided with the second contact portion and is capable of elastic deformation in the direction of contact with the mating terminal;

a fixed piece which is fixed outside; and a third elastic piece which is provided between the first and second elastic pieces and the fixed piece, is elastically deformed in such a manner that the amount of displacement of the second contact portion in the direction of contact with the mating terminal becomes smaller than the amount of displacement of the second contact portion in the insertion and removal direction of the mating terminal when the first contact portion is displaced in the direction of contact with the mating terminal, and is elastically deformed in such a manner that the amount of displacement of the first contact portion in the direction of contact with the mating terminal becomes smaller than the amount of displacement of the first contact portion in the insertion and removal direction of the mating terminal when the second contact portion is displaced in the direction of contact with the mating terminal.

2. The electrical connection terminal according to claim 1, wherein the first contact portion and the second contact portion are spaced from each other in the insertion and removal direction of the mating terminal so as to come into contact with the same widthwise position of the mating terminal.

3. The electrical connection terminal according to claim 2, wherein the first elastic piece and the second elastic piece are provided so as to be positioned in front-and-back relation with respect to the direction of contact with the mating terminal.

4. The electrical connection terminal according to claim 1, wherein the electrical connection terminal is formed by blanking an electrically conductive metal plate in a thickness direction, and wherein the electrical connection terminal is formed in such a manner that the width direction of the fixed piece and each of the elastic pieces becomes the thickness direction of the metal plate.

5. A connector provided with the electrical connection terminal according to claim 1.

6. The connector according to claim 5, wherein a plurality of the electrical connection terminals are provided in two rows with widthwise spacing from each other, wherein terminals in one row and terminals in the other row are arranged in such a manner that the contact portions face each other, and wherein mating terminals are inserted between the terminals in one row and the terminals in the other row.

* * * * *